US006331150B1

(12) United States Patent
Ogg

(10) Patent No.: US 6,331,150 B1
(45) Date of Patent: Dec. 18, 2001

(54) GOLF BALL DIMPLES WITH CURVATURE CONTINUITY

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/398,918

(22) Filed: Sep. 16, 1999

(51) Int. Cl.[7] ..... A63B 37/14
(52) U.S. Cl. ..... 473/383; 473/384
(58) Field of Search ..... 473/318–384

(56) References Cited

U.S. PATENT DOCUMENTS

| | | | | |
|---|---|---|---|---|
| 4,560,168 | | 12/1985 | Aoyama . | |
| 4,762,326 | * | 8/1988 | Gobush | 473/379 |
| 4,813,677 | | 3/1989 | Oka et al. . | |
| 4,840,381 | | 6/1989 | Ihara et al. . | |
| 4,880,241 | | 11/1989 | Melvin et al. . | |
| 4,949,976 | | 8/1990 | Gobush . | |
| 5,158,300 | * | 10/1992 | Aoyama | 473/379 |
| 5,201,522 | | 4/1993 | Pocklington et al. . | |
| 5,566,943 | | 10/1996 | Boehm . | |
| 5,586,951 | * | 12/1996 | Sugiura | 473/379 |
| 5,692,974 | * | 12/1997 | Wu et al. | 473/378 |
| 5,720,676 | | 2/1998 | Shimosaka et al. . | |
| 5,735,757 | | 4/1998 | Moriyama . | |
| 5,757,889 | | 5/1998 | Yamagishi et al. . | |
| 5,857,924 | | 1/1999 | Miyagawa et al. . | |
| 5,906,551 | | 5/1999 | Kasashima et al. . | |
| 5,935,023 | * | 8/1999 | Machara et al. | 473/379 |
| 5,957,786 | * | 9/1999 | Aoyama | 473/379 |

* cited by examiner

*Primary Examiner*—Mark S. Graham
*Assistant Examiner*—Raeann Gorden
(74) *Attorney, Agent, or Firm*—Michael A. Catania

(57) ABSTRACT

A golf ball having a surface thereon with a plurality of dimples on the surface is disclosed herein. The contour of each of the dimples is continuous from a first edge of each of the dimples to a second opposing edge of each of the dimples. The contour at the first edge may be equal to the contour of a sphere of the golf ball. The contour of each of the dimples may be convex from the first edge to a first inflection point and from the second edge to a second inflection point, and the contour may be concave between the first inflection point and the second inflection point. The contour may be defined by the following equation:

$$P(t)=\Sigma B_t J_{n,i}(t) 0 \leq t \leq 1,$$

wherein $$J_{n,i}(t)=\binom{n}{i} t^i (1-t)^{n-i},$$

n is equal to at least five, and i=n+1. The radius of each point from a bottom center to the first edge may be different from any other point from the bottom center to the first edge. The radius may be greatest at the bottom center. The golf ball may have a thermoset polyurethane cover.

17 Claims, 14 Drawing Sheets

GOLF BALL DIMPLES WITH CURVATURE CONTINUITY

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf ball with a dimple pattern on its surface. More specifically, the present invention relates to a dimple pattern for a golf ball where each dimple has a curvature continuity at the entry radius, the inflection point and the center point at the bottom of the dimple.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a patent for a golf ball with indentations (dimples) that flew better ad more accurately than golf balls with brambles. A.G. Spalding & Bros., purchased the U.S. rights to the patent and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octohedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's.

In the 1970's, dimple pattern innovations appeared from the major golf ball manufacturers. In 1973, Titleist introduced an icosahedron pattern which divides the golf ball into twenty triangular regions. An icosahedron pattern was disclosed in British Patent Number 377,354 to John Vernon Pugh, however, this pattern had dimples lying on the equator of the golf ball which is typically the parting line of the mold for the golf ball. Nevertheless, the icosahedron pattern has become the dominant pattern on golf balls today.

In the late 1970s and the 1980's the mathematicians of the major golf ball manufacturers focused their intention on increasing the dimpled surface area (the area covered by dimples) of a golf ball. The dimpled surface for the ATTI pattern golf balls was approximately 50%. In the 1970's, the dimpled surface area increased to greater than 60% of the surface of a golf ball. Further breakthroughs increased the dimpled surface area to over 70%. U.S. Pat. No. 4,949,976 to William Gobush discloses a golf ball with 78% dimple coverage with up to 422 dimples. The 1990's have seen the dimple surface area break into the 80% coverage.

The number of different dimples on a golf ball surface has also increased with the surface area coverage. The ATTI pattern disclosed a dimple pattern with only one size of dimple. The number of different types of dimples increased, with three different types of dimples becoming the preferred number of different types of dimples. U.S. Pat. No. 4,463 to Oka et al., discloses a dimple pattern with four different types of dimples on surface where the non-dimpled surface cannot contain an additional dimple. United Kingdom patent application number 2157959, to Steven Aoyama, discloses dimples with five different diameters. Further, William Gobush invented a cuboctahedron pattern that has dimples with eleven different diameters. See 500 *Year of Golf Balls*, Antique Trade Books, page 189. However, inventing dimple patterns with multiple dimples for a golf ball only has value if such a golf ball is commercialized and available for the typical golfer to play.

Additionally, dimple patterns have been based on the sectional shapes, such as octahedron, dodecahedron and icosahedron pstterns. U.S. Pat. No. 5,201,522 discloses a golf ball dimple pattern having pentagonal formations with equally number of dimples therein. U.S. Pat. No. 4,880,241 discloses a golf ball dimple pattern having a modified icosahedron pattern wherein small triangular sections lie along the equator to provide a dimple-free equator.

To further enhance aerodynamics for the flight of a golf ball, the designs of the dimples have been studied and improved upon by the golf industry. For example, Shimosaka et al., U.S. Pat. No. 5,720,676 for a Golf Ball, discloses a cross-sectional area of each dimple that is equal 0.01 mm below the dimple edge. The dimples of the Shimoska patent have an equivalent cross-section below this level since the edges of the dimples above 0.01 mm are rounded after painting thereby departing from a master's reverse dimple pattern.

Another example is Ihara et al, U.S. Pat. No. 4,840,381, for a Golf Ball, and Yamagishi et al., U.S. Pat. No. 5,752,889, for a Two-Piece Solid Golf Ball, both of which disclose a gentle transition over the edge portion of each dimple. The Ihara and Yamagishi patents are particularly directed at a golf ball with a cover composed of an ionomer material.

Yet another example is Kasashima et al., U.S. Pat. No. 5,906,551 for a Golf Ball, which discloses having dimples on the parting line. The dimples on the parting line have an entry angle that is greater than dimples that do not lie on the parting line. The use of a larger entry angle for parting line dimples in the Kasashima patent is to improve the symmetry.

Another example of entry angles of dimples is disclosed in Miyagawa et al, U.S. Pat. No. 5,857,924, for a Golf Ball. The Miyagawa patent has the entry angle between 5 and 20 degrees in order to prevent lowering of the spin susceptibility due to repetitive hits.

Another example of manipulation of the edge of a dimple is disclosed in Oka, et al., U.S. Pat. No. 4,813,677, for a Golf Ball. The Oka patent has a sharp inclination for the dimple wall surface to increase the volume of the dimple.

A departure from gradual dimples edges is disclosed in Boehm, U.S. Pat. No. 5,566,943 for a Golf Ball. The Boehm patent discloses dimples that have a constant depth for the entire dimple area. Essentially, the side wall of the dimple of the Boehm patent is at a 90 degree angle to the surface which should improve resistance to hits with an iron.

Although there are hundreds of published patents related to golf ball dimples, there still remains a need to improve upon current dimples, particularly for golf balls with thermoset polyurethane covers. Golf balls with thermoset polyurethane covers such as the Maxfli REVOLUTION, the Maxfli HT, the Titleist PROFESSIONAL, the Titleist TOUR PRESTIGE, and the Slazenger RAM 420 all need to compensate for the inherent properties of the polyurethane material which prevents the use of certain manufacturing techniques available to covers composed of ionomer materials such as roto-finishing. One example to overcome this problem is a dual radius design such as disclosed in Moriyama, U.S. Pat. No. 5,735,757. However, there is still a need for a dimple designed to maximize the aerodynamics of a golf ball with a thermoset polyurethane cover.

BRIEF SUMMARY OF THE INVENTION

The present invention provides a novel dimple cross-section that reduces the drag on a golf ball while increasing its lift for greater distances. The present invention is able to accomplish this by providing a continuous curvature for each of the dimples based on a quints Bézier.

One aspect of the present invention is a golf ball having a surface thereon with a plurality of dimples on the surface. The contour of each of the dimples is continuous from a first edge of each of the dimples to a second opposing edge of each of the dimples.

The contour at the first edge may be equal to the curvature of a sphere of the golf ball. The curvature of each of the dimples may be convex from the first edge to a first inflection point and from the second edge to a second inflection point, and the curvature may be concave between the first inflection point and the second inflection point. The dimple contour may be defined by the following equation:

$$P(t)=\Sigma B_t J_{n,i}(t) 0 \leqq t \leqq 1$$

wherein $$J_{n,i}(t)=\binom{n}{i} t^i (1-t)^{n-i}$$

n is equal to at least five, and i=n+1.

The radius of each point from a bottom center to the first edge may be different from any other point from the bottom center to the first edge. The radius may be greatest at the bottom center.

Another aspect of the present invention is a golf ball having a thermoset polyurethane cover with a surface thereon. The surface of the thermoset polyurethane cover is coated with at least a base coat. The golf ball has a plurality of dimples on the surface, and the contour of each of the dimples is continuous from a first edge of each of the dimples to a second opposing edge of each of the dimples.

Another aspect of the present invention is an unfinished golf ball having an uncoated thermoset polyurethane cover with the cover having an uncoated surface. The golf ball has a plurality of dimples on the uncoated surface, and the contour of each of the dimples is continuous from a first edge of each of the dimples to a second opposing edge of each of the dimples.

Yet another aspect of the present invention is a golf ball having a surface thereon with a plurality of dimples disposed on the surface. The contour of each of the dimples extends from a first edge of each of the dimples to a second opposing edge of each of the dimples, and the radius of curvature at each point along the contour from the first edge to a bottom center is different from any other point from the first edge to the bottom center.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is an equatorial view of a preferred embodiment of a golf ball of the present invention.

DETAILED DESCRIPTION OF THE INVENTION

Figure 1A:
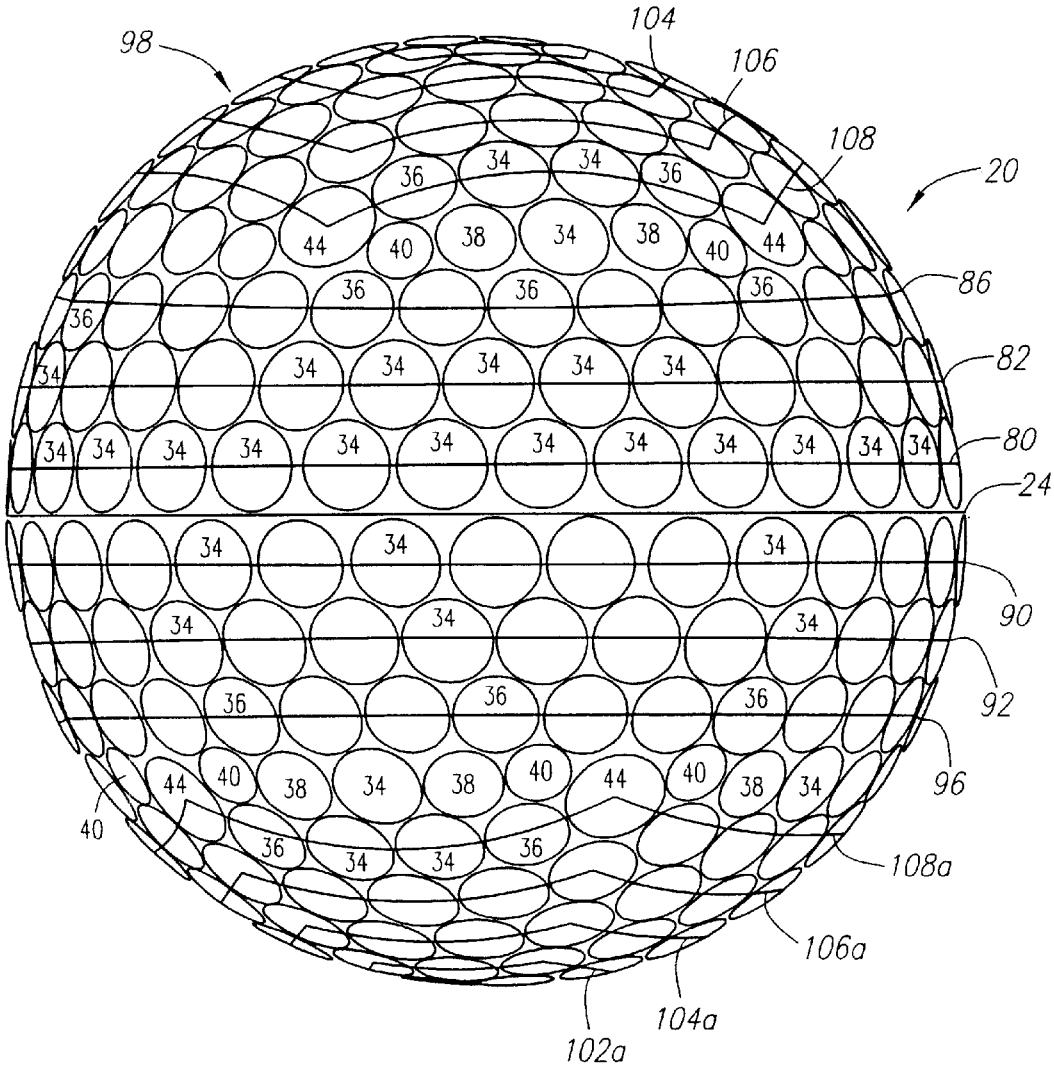
FIG. 1A is the view of FIG. 1 illustrating the rows of dimples.
Figure 1B:
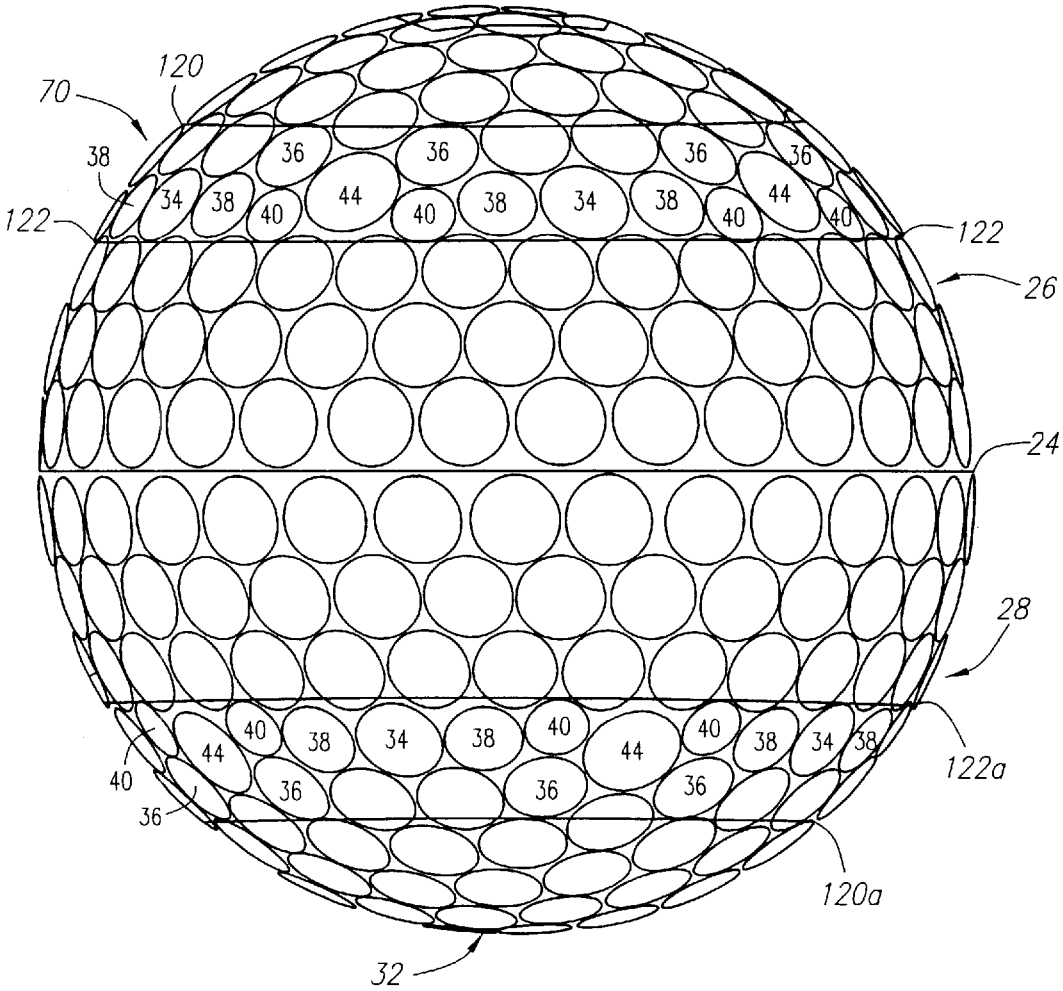
FIG. 1B is the view of FIG. 1 illustrating the transition region of dimples.
Figure 2:
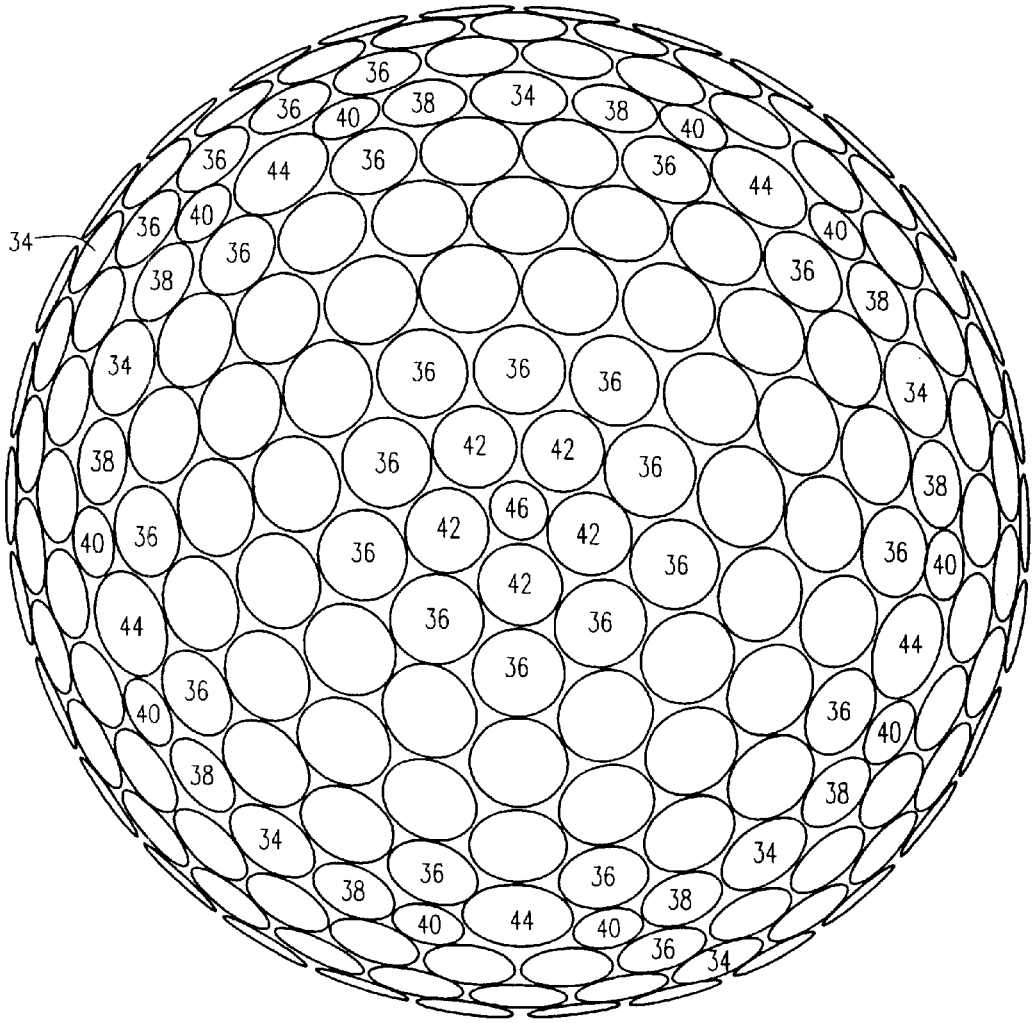
FIG. 2 is a polar view of the golf ball of FIG. 1.
Figure 3:
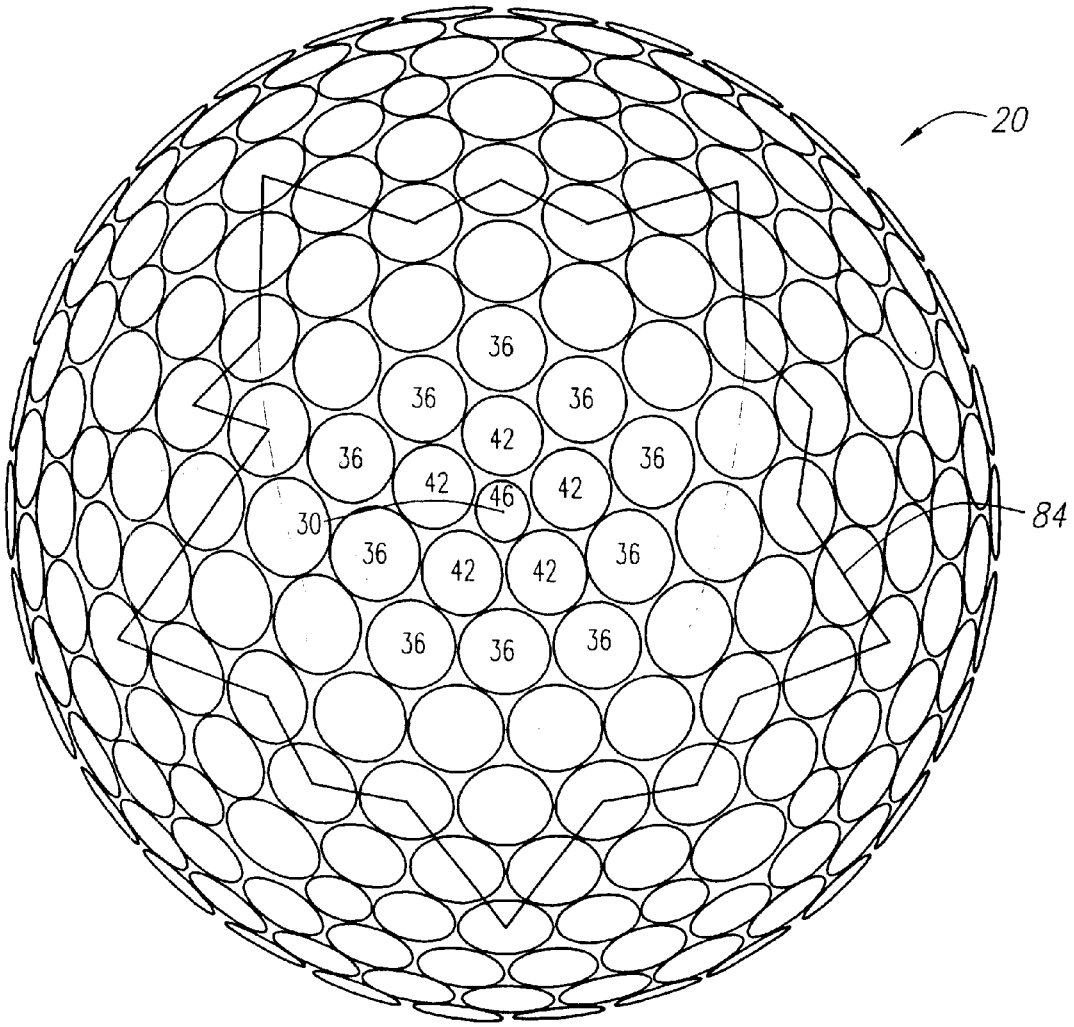
FIG. 3 is a polar view of the golf ball of FIG. 1 illustrating the star configuration.

As shown in FIGS. 1–3, a golf ball is generally designated 20. The golf ball may be a two-piece or a three piece golf ball. Further, the three-piece golf ball may have a wound layer, or a solid boundary layer. The cover of the golf ball 20 may be any suitable material. A preferred cover is composed of a thermoset polyurethane material. However, those skilled in the pertinent art will recognize that other cover materials may be utilized without departing from the scope and spirit of the present invention. The golf ball 20 may have a finish of a basecoat and/or top coat.

The golf ball 20 has a surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

On the surface 22, in both hemispheres 26 and 28, are 382 dimples partitioned into seven different sets of dimples. A first set of dimples 34 are the most numerous dimples consisting of two-hundred twenty dimples in the preferred embodiment. A second set of dimples 36 are the next most numerous dimples consisting of one-hundred dimples. A third set of dimples 38 and a fourth set of dimples 40 are the next most numerous with each set 38 and 40 consisting of twenty dimples in the preferred embodiment. A fifth set of dimples 42 and a sixth set of dimples 44 are the next most numerous with each set 42 and 44 consisting of ten dimples in the preferred embodiment. The seventh set of dimples 46 consist of only two dimples. In a preferred embodiment, the 382 dimples account for 86% of the surface 22 of the golf ball.

The two dimples of the seventh set of dimples 46 are each disposed on respective poles 30 and 32. Each of the fifth set of dimples 42 is adjacent one of the seventh set of dimples 46. The five dimples of the fifth set of dimples 42 that are disposed within the first hemisphere 26 are each an equal distance from the equator 24 and the first pole 30. The five dimples of the fifth set of dimples 42 that are disposed within the second hemisphere 28 are each an equal distance from the equator 24 and the second pole 32. These polar dimples 42 and 46 account for approximately 2% of the surface 22 of the golf ball 20.

Figure 8:
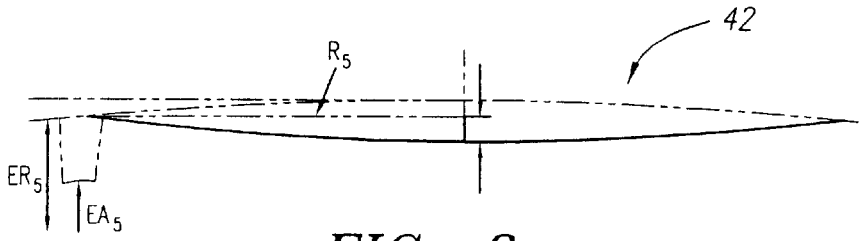
FIG. 8 is an enlarged cross-sectional view of a dimple of a fifth set of dimples of the golf ball of the present invention.

A cross-section of a dimple of the fifth set of dimples 42 is shown in FIG. 8. The radius $R_5$ of the dimple 42 is approximately 0.0720 inches, the chord depth $C_5$ is approximately 0.0054 inches, the entry angle $\theta_5$ is approximately 15.7 degrees, and the entry radius $ER_5$ is approximately 0.0336 inches. Unlike the use of the term "entry radius" or "edge radius" in the prior art, the entry radius as defined herein is a value utilized in conjunction with the entry angle to delimit the concave and convex segments of the dimple contour. The first and second derivatives of the two Bézier curves are forced to be equal at this point defined by the entry radius and the entry angle, as shown in FIG. 4A.

Figure 10:
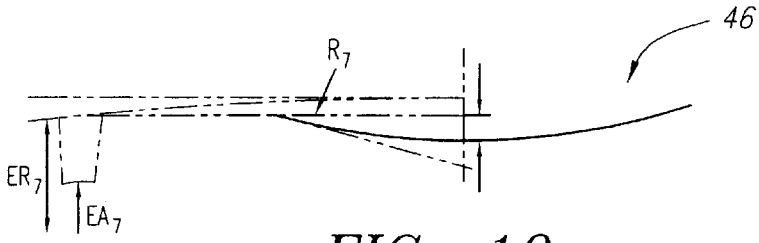
FIG. 10 is an enlarged cross-sectional view of a dimple of a seventh set of dimples of the golf ball of the present invention.

A cross-section of a dimple of the seventh set of dimples 46 is shown in FIG. 10. The radius $R_7$ of the dimple 46 is approximately 0.0510 inches, the chord depth $C_7$ is approximately 0.0049 inches, the entry angle $\theta_7$ is approximately 13.4 degrees, and the entry radius $ER_7$ is approximately 0.0336 inches.

The ten dimples of the sixth set of dimples 44 account for approximately 3% of the surface 22 of the golf ball 20. The five dimples of the sixth set of dimples 44 that are disposed within the first hemisphere 26 are each an equal distance from the equator 24 and the first pole 30. The five dimples of the sixth set of dimples 44 that are disposed within the second hemisphere 28 are each an equal distance from the equator 24 and the second pole 32. Also, each of the sixth set of dimples 44 is adjacent to three different sets of dimples 34, 36 and 40.

Figure 9:
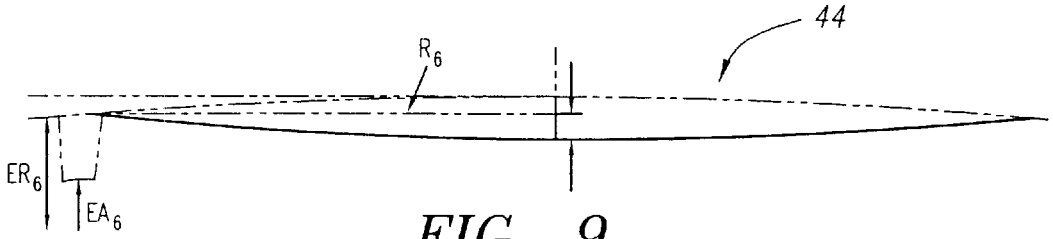
FIG. 9 is an enlarged cross-sectional view of a dimple of a sixth set of dimples of the golf ball of the present invention.

A cross-section of a dimple of the sixth set of dimples 44 is shown in FIG. 9. The radius $R_6$ of the dimple 44 is approximately 0.0930 inches, the chord depth $C_6$ is approximately 0.0051 inches, the entry angle $\theta_6$ is approximately 15.2 degrees, and the entry radius $ER_6$ is approximately 0.0333 inches. The extraordinarily large diameter of each of the sixth set of dimples 44 allows for the extraordinary surface coverage of the dimple pattern of the present invention. This is contrary to conventional thinking that teaches that dimples with smaller diameters would provide for greater surface coverage.

All of the fourth set of dimples 40 are adjacent to at least one of the sixth set of dimples 44. The twenty dimples of the fourth set of dimples 40 cover approximately 2.7% of the surface 22 of the golf ball 20. The ten dimples of the fourth set of dimples 40 that are disposed within the first hemisphere 26 are each an equal distance from the equator 24 and the first pole 30. The ten dimples of the fourth set of dimples 40 that are disposed within the second hemisphere 28 are each an equal distance from the equator 24 and the second pole 32. Also, each of the fourth set of dimples 40 is adjacent to three different sets of dimples 36, 38 and 44.

Figure 7:
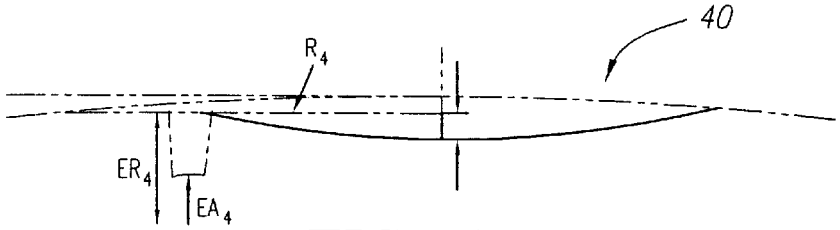
FIG. 7 is an enlarged cross-sectional view of a dimple of a fourth set of dimples of the golf ball of the present invention.

A cross-section of a dimple of the fourth set of dimples 40 is shown in FIG. 7. The radius $R_4$ of the dimple 40 is approximately 0.062 inches, the chord depth $C_4$ is approximately 0.0052 inches, the entry angle $\theta_4$ is approximately 15.2 degrees, and the entry radius $ER_4$ is approximately 0.0358 inches.

All of the third set of dimples 38 are adjacent to at least one of the sixth set of dimples 44. The twenty dimples of the third set of dimples 38 cover approximately 3.8% of the surface 22 of the golf ball 20. The ten dimples of the third set of dimples 38 that are disposed within the first hemisphere 26 are each an equal distance from the equator 24 and the first pole 30. The ten dimples of the third set of dimples 38 that are disposed within the second hemisphere 28 are each an equal distance from the equator 24 and the second pole 32. Also, each of the fourth set of dimples 38 is adjacent to three different sets of dimples 34, 36 and 40.

Figure 6:
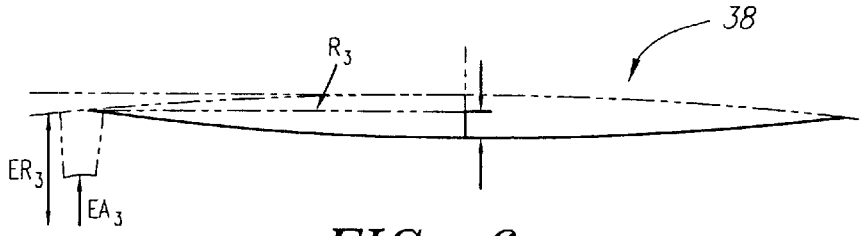
FIG. 6 is an enlarged cross-sectional view of a dimple of a third set of dimples of the golf ball of the present invention.

A cross-section of a dimple of the third set of dimples 38 is shown in FIG. 6. The radius $R_3$ of the dimple 38 is approximately 0.074 inches, the chord depth $C_3$ is approximately 0.0053 inches, the entry angle $\theta_3$ is approximately 15.3 degrees, and the entry radius $ER_3$ is approximately 0.0344 inches.

The two-hundred twenty dimples of the first set of dimples 34 are the most influential of the different sets of dimples 34–46 due to their number, size and placement on the surface 22 of the golf ball 20. The two-hundred twenty dimples of the first set of dimples 34 cover approximately 53% of the surface 22 of the golf ball 20. The one-hundred ten dimples of the first set of dimples 34 that are disposed within the first hemisphere 26 are disposed in either a first row 80 and a second row 82 above the equator 24, or a pseudo-star configuration 84 about the first pole 30 that is best illustrated in FIG. 3. Similarly, the one-hundred ten dimples of the first set of dimples 34 that are disposed within the second hemisphere 28 are disposed in either a first row 90 and a second row 92 below the equator 24, or a pseudo-star configuration 94, not shown, about the second pole 32, not shown.

Figure 4:
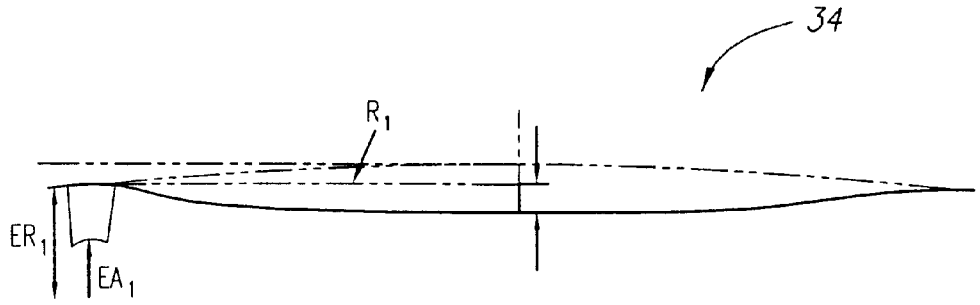
FIG. 4 is an enlarged cross-sectional view of a dimple of a first set of dimples of the golf ball of the present invention.
Figure 4A:
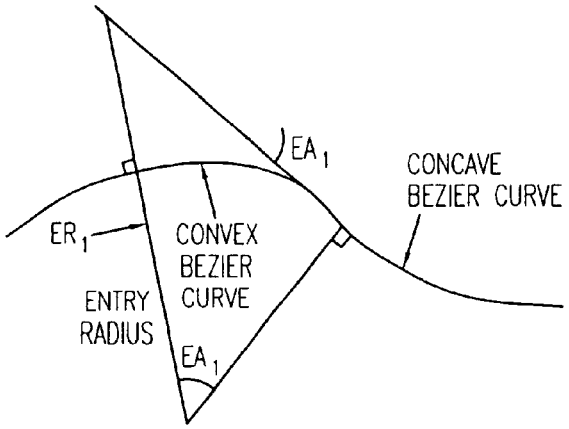
FIG. 4A is an isolated cross-sectional view to illustrate the definition of the entry radius.

A cross-section of a dimple of the first set of dimples 34 is shown in FIG. 4. The radius $R_1$ of the dimple 34 is approximately 0.0834 inches, the chord depth $C_1$ is approximately 0.0053 inches, the entry angle $\theta_1$ is approximately 15.3 degrees, and the entry radius $ER_1$ is approximately 0.0344 inches.

The one-hundred dimples of the second set of dimples 36 are the next most influential of the different sets of dimples 34–46 due to their number, size and placement on the surface 22 of the golf ball 20. The one-hundred dimples of the second set of dimples 36 cover approximately 22% of the surface 22 of the golf ball 20. Thus, together the first set of dimples 34 and the second set of dimples 36 cover over approximately 75% of the surface 22 of the golf ball 20. The fifty dimples of the second set of dimples 36 that are disposed within the first hemisphere 26 are disposed in either a third row 86 above the equator, a second pentagon 102 about the first pole 30, or along a transition latitudinal region 70. Similarly, the fifty dimples of the second set of dimples 36 that are disposed within the second hemisphere 28 are disposed in either a third row 96 below the equator 24, a second pentagon 102*a*, not shown, about the second pole 32, or along a transition latitudinal region 72.

Figure 5:
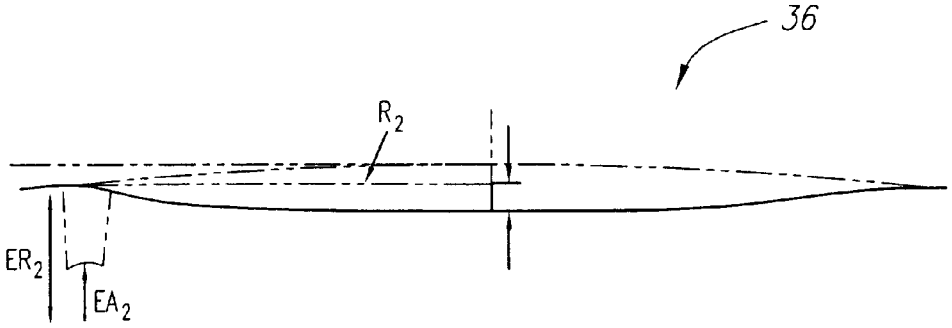
FIG. 5 is an enlarged cross-sectional view of a dimple of a second set of dimples of the golf ball of the present invention.

A cross-section of a dimple of the second set of dimples 36 is shown in FIG. 5. The radius $R_2$ of the dimple 36 is approximately 0.079 inches, the chord depth $C_2$ is approximately 0.0053 inches, the entry angle $\theta_2$ is approximately 15.1 degrees, and the entry radius $ER_2$ is approximately 0.0315 inches.

Figure 2A:
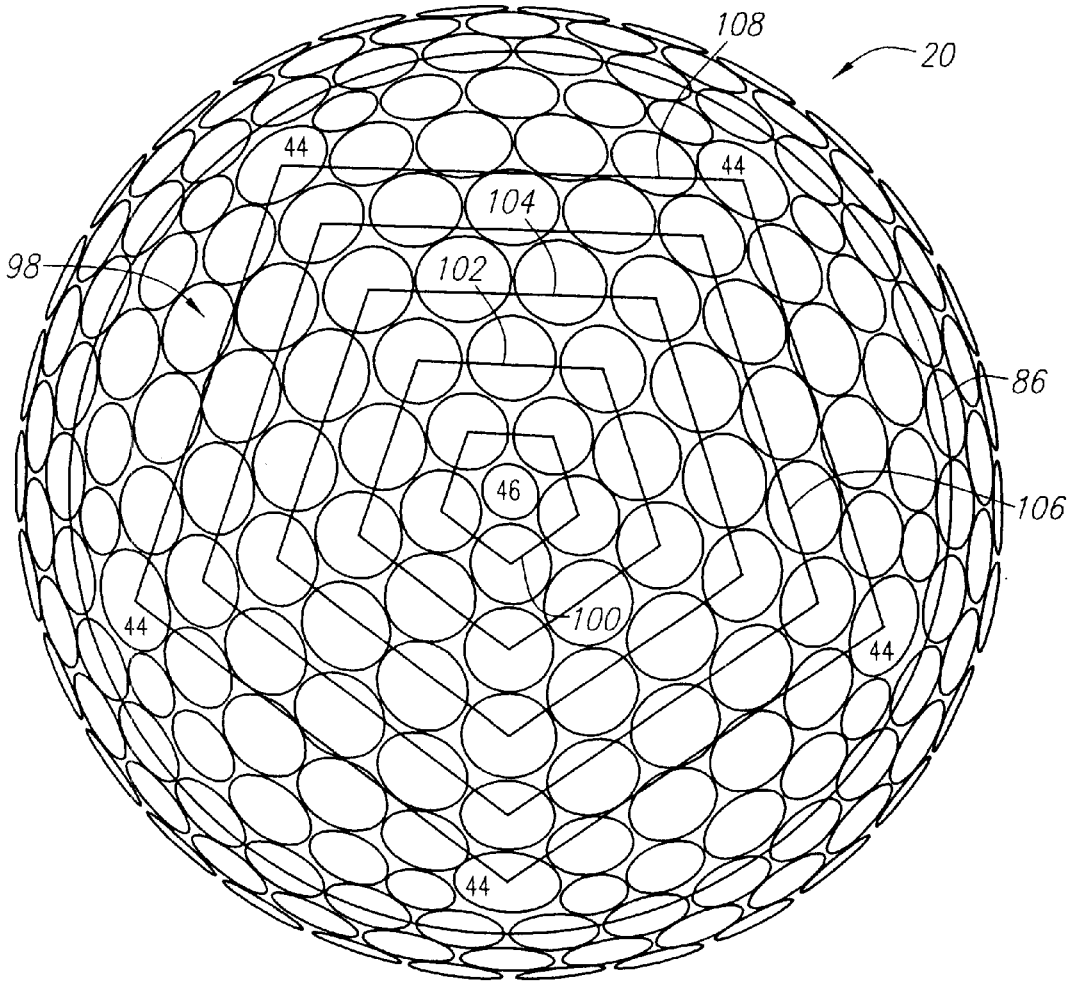
FIG. 2A is the view of FIG. 2 illustrating the cascading pentagons of dimples.

As best illustrated in FIG. 1A, each hemisphere 26 and 28 begins with three rows from the equator 24. The first and second rows 80 and 82 of the first hemisphere 26 and the first and second rows 90 and 92 of the second hemisphere 28 are composed of the first set of dimples 34. The third row 86 of the first hemisphere 26 and the third row 96 of the second hemisphere 28 are composed of the second set of dimples 36. This pattern of rows is utilized to achieve greater surface area coverage of the dimples on the golf ball 20. However, as mentioned previously, conventional teaching would dictate that additional rows of smaller diameter dimples should be utilized to achieve greater surface area coverage. However, the dimple pattern of the present invention transitions from rows of equal dimples into a pentagonal region 98. The pentagonal region 98 is best seen in FIG. 2A. A similar pentagonal region 98*a*, not shown, is disposed about the second pole 32. The pentagonal region 98 has five pentagons 100, 102, 104, 106 and 108 expanding from the first pole 30. Similar pentagons 100*a*, 102*a*, 104*a*, 106*a* and 108*a* expand from the second pole 32. The first pentagon 100 consists of the fifth set of dimples 42. The second pentagon 102 consists of the second set of dimples 36. The third pentagon 104 consists of the first set of dimples 34. The fourth pentagon 106 also consists of the first set of dimples 34. The fifth pentagon 108 consists of the first set of dimples 34 and the sixth set of dimples 44. However, the greater fifth pentagon 108' would include the fifth pentagon 108 and all dimples disposed between the third row 86 and the fifth pentagon 108. The pentagonal region 98 allows for the greater surface area of the dimple pattern of the present invention.

Figure 2B:
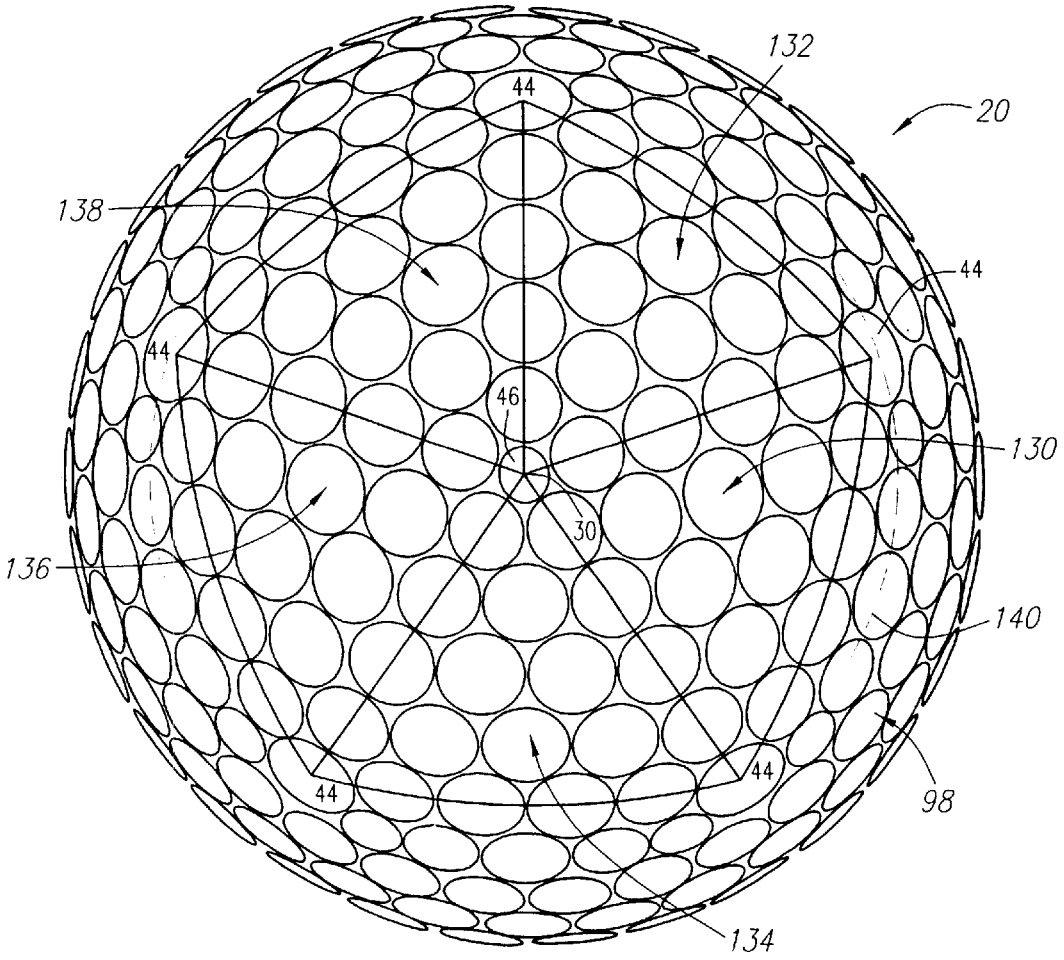
FIG. 2B is the view of FIG. 2 illustrating the single encompassing pentagon of dimples.

FIG. 2B illustrates five triangles 130–138 that compose the pentagonal region 98. Dashed line 140 illustrates the extent of the greater pentagonal region 98' which overlaps with the transition latitudinal region 70.

As best illustrated in FIG. 1B, all of the dimples of the third set of dimples 38, the fourth set of dimples 40 and the sixth set of dimples 44 are disposed within the transition latitudinal regions 70 and 72. The transition latitudinal regions 70 and 72 transition the dimple pattern of the present invention from the rows 80, 82, 86, 90, 92 and 96 to the pentagonal regions 98 and 98*a*. Each of the transition latitudinal regions 70 and 72 cover a circumferencial area between 40 to 60 longitudinal degrees from the equator 24 in their respective hemispheres 26 and 28. The first transition latitudinal region 70 has a polar boundary 120 at approximately 60 longitudinal degrees from the equator 24, and an equatorial boundary 122 at approximately 40 longitudinal degrees from the equator 24. Similarly, the second transition latitudinal region 72 has a polar boundary 120*a* at approximately 60 longitudinal degrees from the equator 24, and an equatorial boundary 122*a* at approximately 40 longitudinal degrees from the equator 24.

Figure 11:
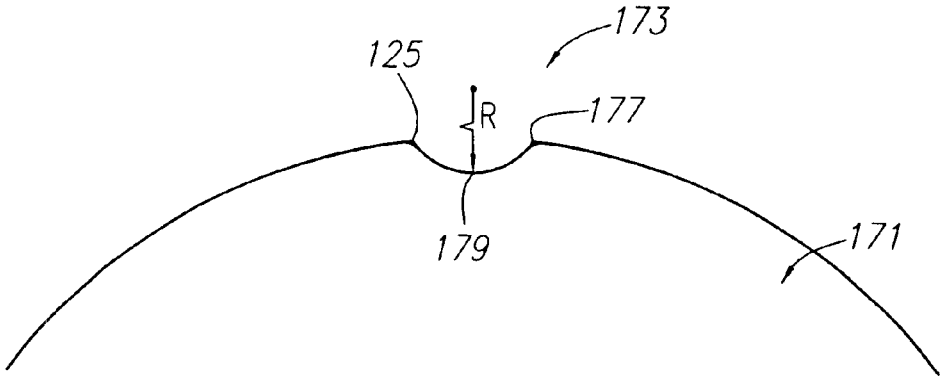
FIG. 11 (PRIOR ART)
FIG. 11 is a cross-sectional view of a dimple of the prior art.
Figure 12:
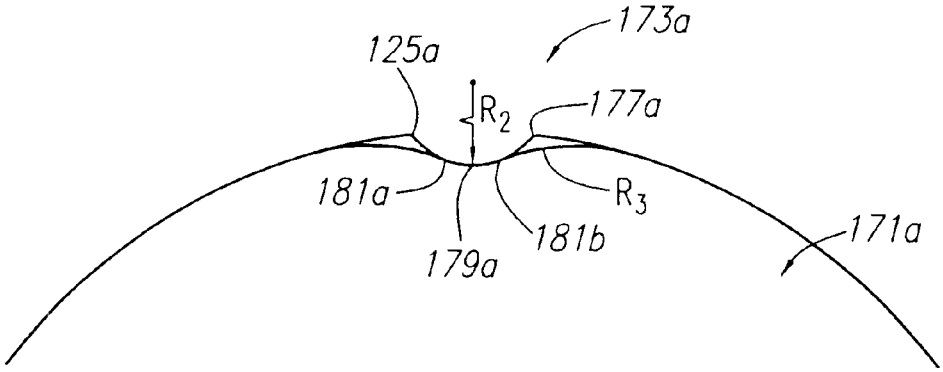
FIG. 12 (PRIOR ART)
FIG. 12 is a cross-sectional view of another dimple of the prior art.
Figure 13:
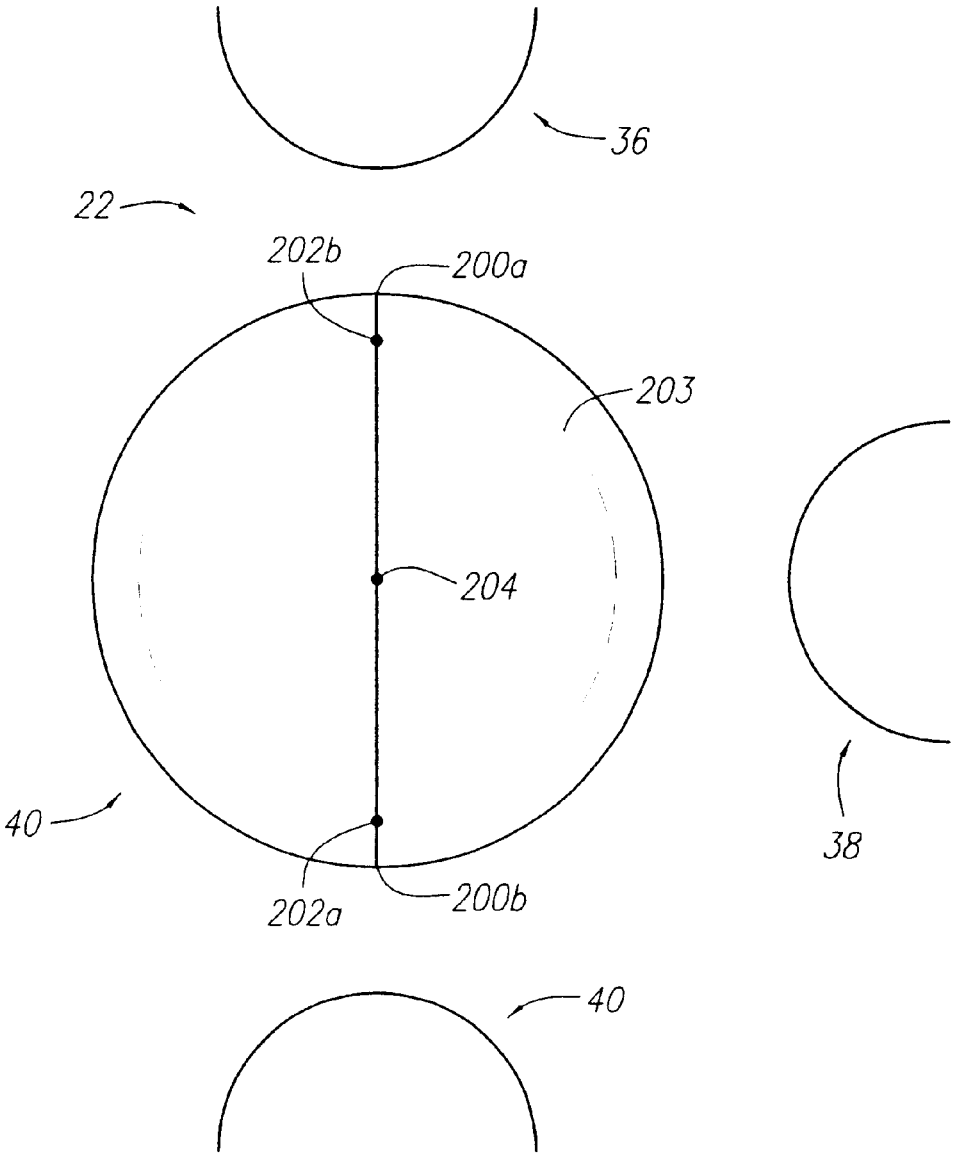
FIG. 13 is an isolated top plan view of a dimple of the present invention.
Figure 14:
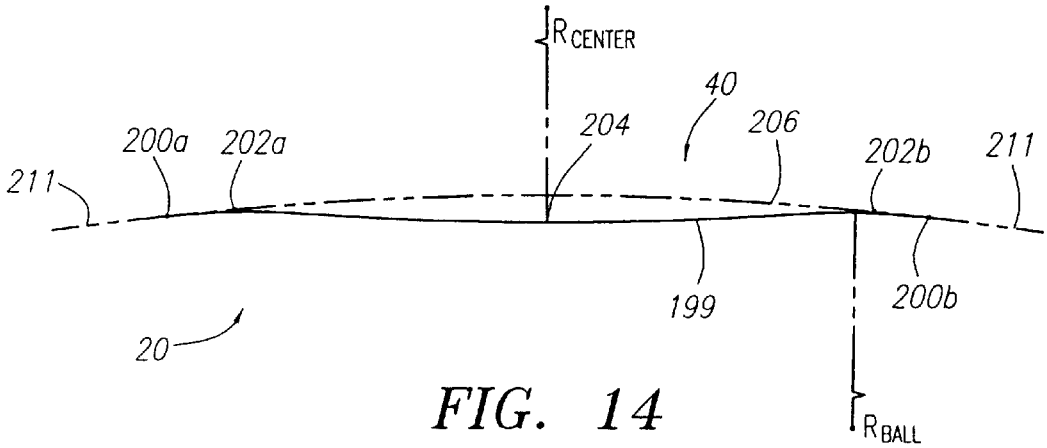
FIG. 14 is a cross-sectional side view of the dimple of FIG. 13.
Figure 14A:
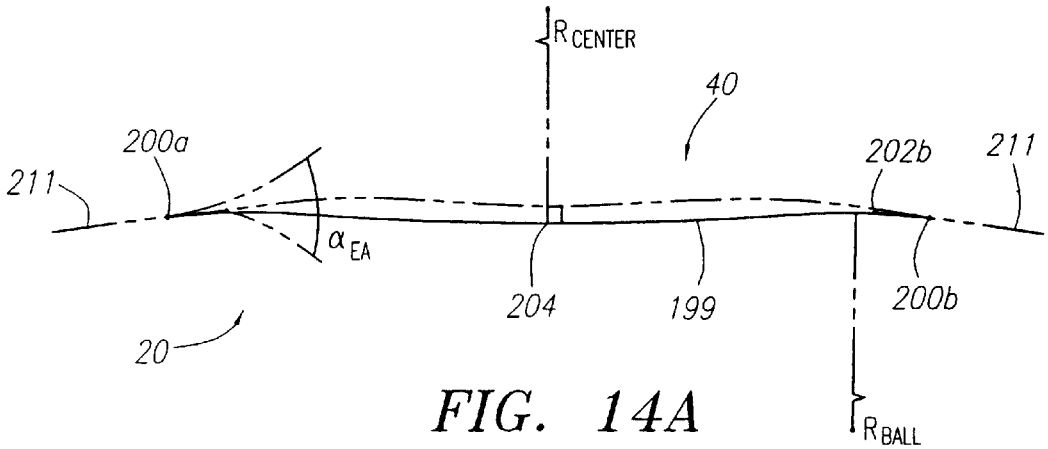
FIG. 14*a* is a cross-sectional side view of the dimple of FIG. 13 illustrating the entry angle and the chord depth.
Figure 14B:
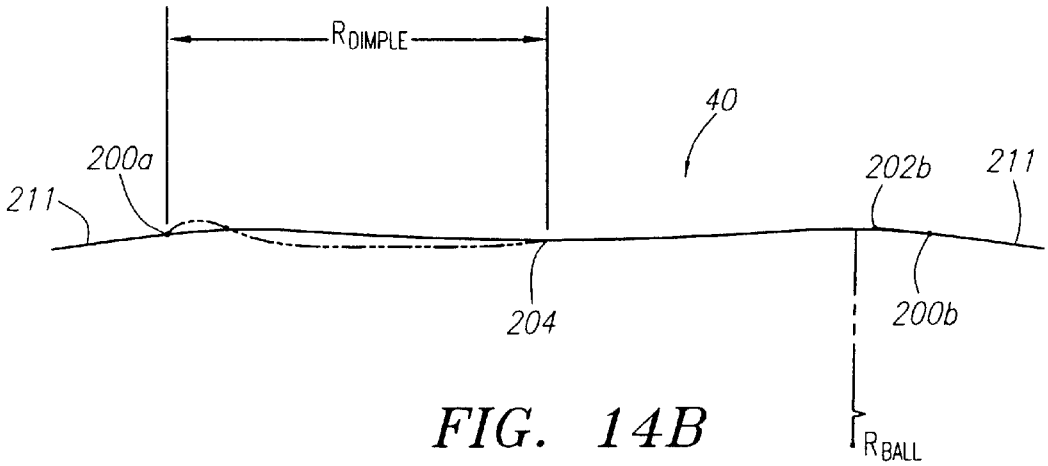
FIG. 14*b* is a cross-sectional side view of the dimple of FIG. 13 illustrating the briding curves used to construct the curvature of the dimple.

FIGS. 11 and 12 illustrate the cross-sections of dimples of the prior art. As shown in FIG. 11, the prior art golf ball 171 has a cross-section of a dimple 173 that has the same radius, "R", from one end 175 of the dimple 173 to the other end 177 of the dimple 173. More precisely, the radius R of the center 179 of the dimple 173 is equal to the radius R at either end 175 or 177. Such a golf ball 171 of the prior art usually has a cover composed of an ionomer material that allows for roto-finishing to create a smoother edge where the spherical surface of the golf ball 171 ends and the dimple 173 begins.

The golf ball 171*a* of the prior art shown in FIG. 12 usually has a cover composed of a thermoset polyurethane material which has greater durability than an ionomer material. However, the polyurethane cover cannot be roto-finished to create a smoother edge. Therefore, the prior art, such as disclosed in U.S. Pat. No. 5,735,757, has created a dimple 173*a* that has a dual radius. As illustrated in FIG. 12, the center 179*a* has a radius R2 that is different from that of either end 175*a* or 177*a* Thus, between transition points 181*a–b*, the dimple 173*a* has a radius R2, and from points 181*a* to 175*a* and 181*b* to 177*a*, the dimple 173*a* has a radius R1. The radius R3 illustrates the desired radius to simulate a roto-finished golf ball. This creates a discontinuous contour for the dimple 173*a*.

As shown in FIGS. 13, 14, 14A and 14B, the golf ball 20 of the present invention has a contour 199 that is unlike the contour of the prior art golf balls. The dimples of the golf ball 20 of the present invention have a continuous contour 199 with a changing radius along the entire contour 199. The contour 199 begins at an edge 200*a* and ends at another edge 200*b*. The contour 199 inflects at inflection points 202*a* and 202*b*. A dashed line 203 illustrates annular inflection of the dimple 40. The contour 199 has a bottom center 204 where the depth of the dimple 40 is at its greatest depth. The golf ball 20 has a curvature 206 that matches the spherical ace 211 of the non-dimpled area of the golf ball 20. The dashed lines indicate the phantom curvature 206 of the golf ball over the dimple 40. The curvature 206 of the golf ball 20 is equal to the contour 199 of the dimple at each of the edges 200*a* and 200*b*. This equality in the contour 199 and the curvature 206 at the edges 200*a* and 200*b* allows for a smooth transition of air into the dimple 40 during the flight of the golf ball 20. The air pressure acting on the golf ball 20 during its flight is driven by the contour 199 of each dimple 40. Reducing the discontinuity of the contour 199 reduces the discontinuity in the air pressure distribution during the flight of the golf ball 20 which reduces the separation of the turbulent boundary layer that is created during the flight of the golf ball 20.

Figure 15:
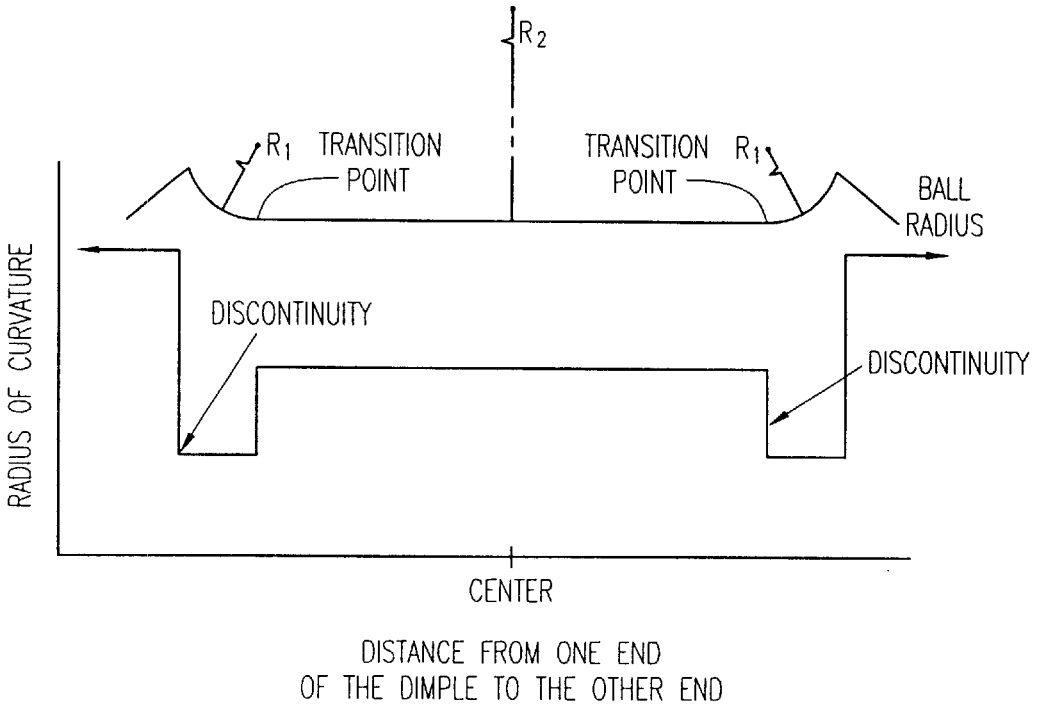
FIG. 15 (PRIOR ART)
FIG. 15 is a combination of a graph of the distance from one end of a dimple to an opposing end versus the radius, with a cross-section of the dimple, for a dimple of the prior art to demonstrate the curvature discontinuity.
Figure 16:
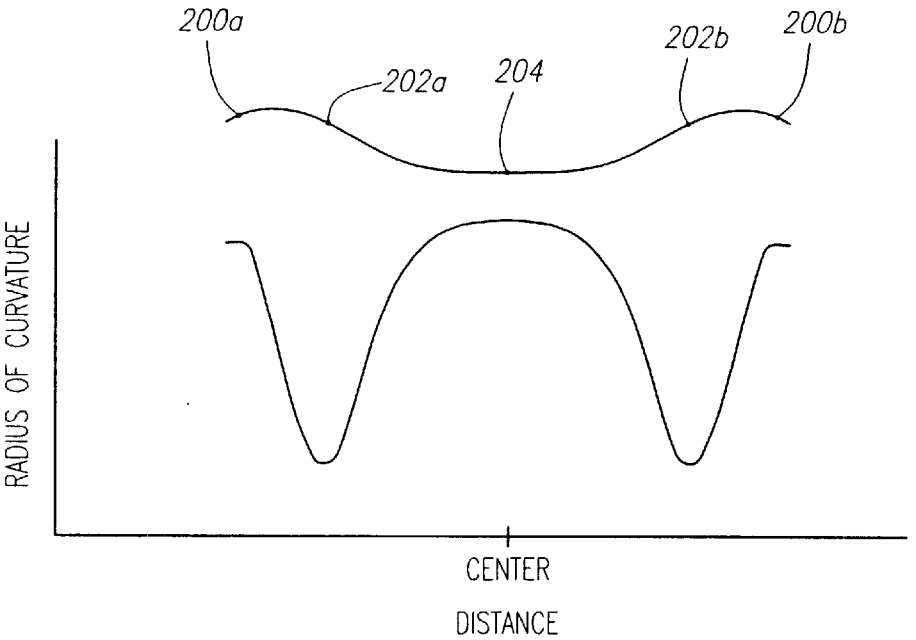
FIG. 16 is a combination of a graph of the distance from one end of a dimple to an opposing end versus the radius, with a cross-section of the dimple, for a dimple of the present invention to demonstrate the curvature continuity.

The differences in contours of dimples of the golf ball 20 of the present invention and dimples of golf balls of the prior art is best illustrated in FIGS. 15 and 16. As shown in FIG. 15 for a dual radius dimple (similar to that of FIG. 12), the contour has a discontinuity at the transition points. In contrast, as shown in FIG. 16, the contour 199 of the present invention is continuous for the entire contour with a peak at the bottom center of the dimple 40. Although the dimple 40 is shown as an example, most or all of the other dimples on a golf ball 20 of the present invention have a similar contour 199. The contour 199 may be characterized as a concave between inflection points 202*a* and 202*b*, and as convex from edge 200*a* to inflection point 202*a* and from inflection point 202*b* to edge 200*b*.

The contour 199 of the dimples 40 of the present invention are based on a fifth degree Bézier polynomial having the formula:

$$P(t)=\Sigma B_t J_{n,i}(t) 0 \leqq t \leqq 1$$

wherein P(t) are the parametric defining points for both the convex and concave portions of the dimple cross section, the Bézier blending function is $$J_{n,i}(t)=\binom{n}{i} t^i (1-t)^{n-i}$$

and n is equal to the degree of the defining Bézier blending function, which for the present invention is preferably five. t is a parametric coordinate normal to the axis of revolution of the dimple. $B_i$ is the value of the ith vertex of defining the polygon, and i=n+1. A more detailed description of the Bézier polynomial utilized in the present invention is set forth in *Mathematical Elements For Computer Graphics,* Second Edition, McGraw-Hill, Inc., David F. Rogers and J. Alan Adams, pages 289–305, which are hereby incorporated by reference.

For the present invention, the equations defining the dimple cross sectional shape requires the location of the edges 200*a* and 200*b*, the inflection points 202*a* and 202*b*, the bottom center 204, the entry angle EA, the radius of the golf ball $R_{ball}$, the radius of the dimple $R_D$, the entry radius $R_E$, the curvature at the bottom center 204, and the chord depth C. This information allows for the contour 199 of the dimple 40 to be designed to be continuous throughout the dimple 40. In constructing the contour 199, two associative bridge curves are prepared as the basis of the contour 199. The first bridge curve 220 is overlaid from the edge 200*a* to the inflection point 202*a* which eliminates the step discontinuity in the curvature that results from having true arcs point continuous and tangent. The second bridge curve 222 is overlaid from the inflection point 202*a* to the bottom center 204. The attachment of the bridge curves 220 and 222 at the inflection point 202*a* allows for equivalence of the curvature and controls the contour 199. The dimensions of the curvature at the bottom center 204 also controls the contour 199. The shape of the contour 199 may be refined using the parametric stiffness controls available at each of the bridge curve 220 and 222. The controls allow for the fine tuning of the shape of the dimple 40 by scaling tangent and curvature poles on each end of the bridge curves 220 and 222.

Figure 17:
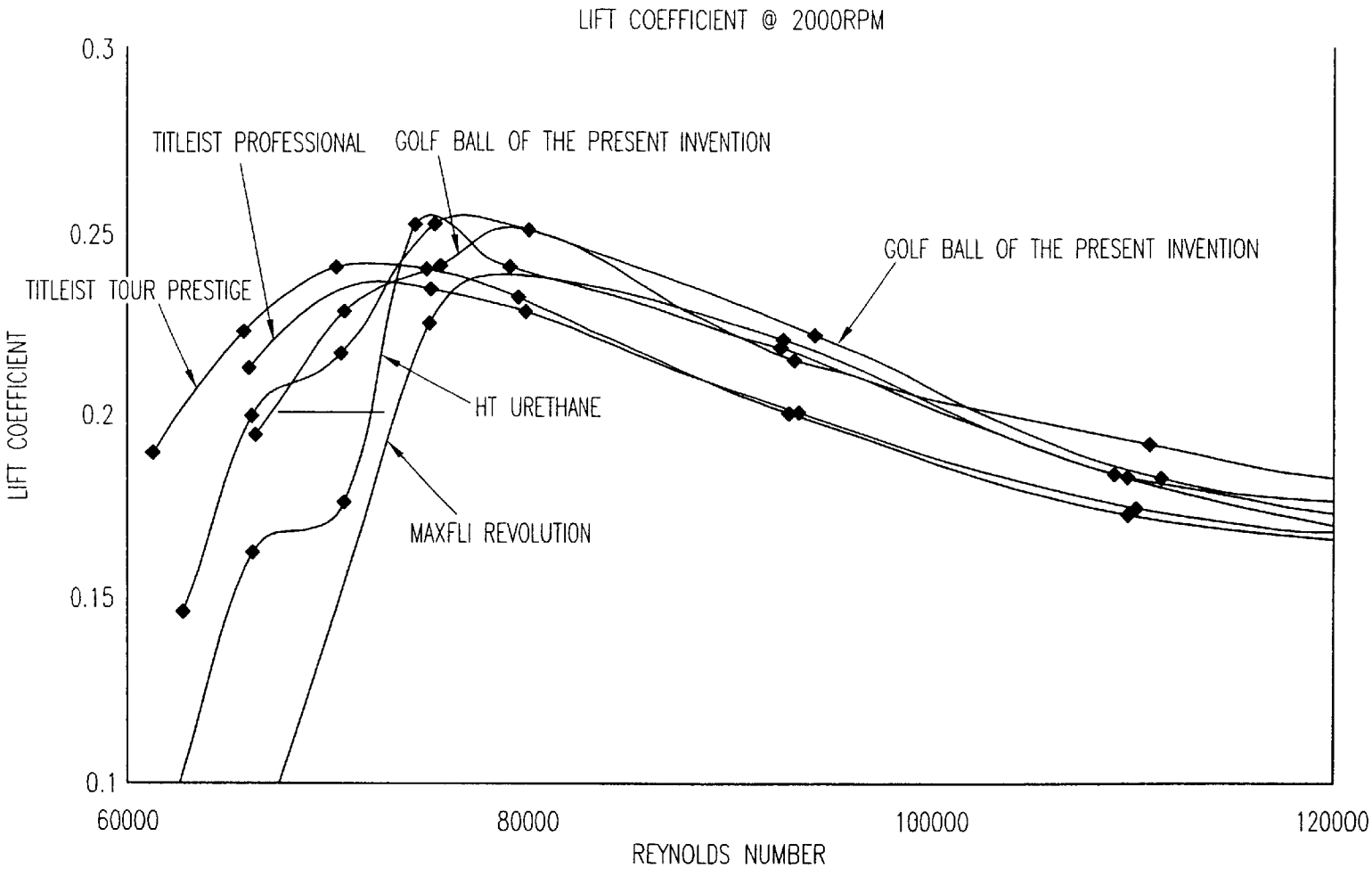
FIG. 17 is a graph of the lift coefficient versus Reynolds number.
Figure 18:
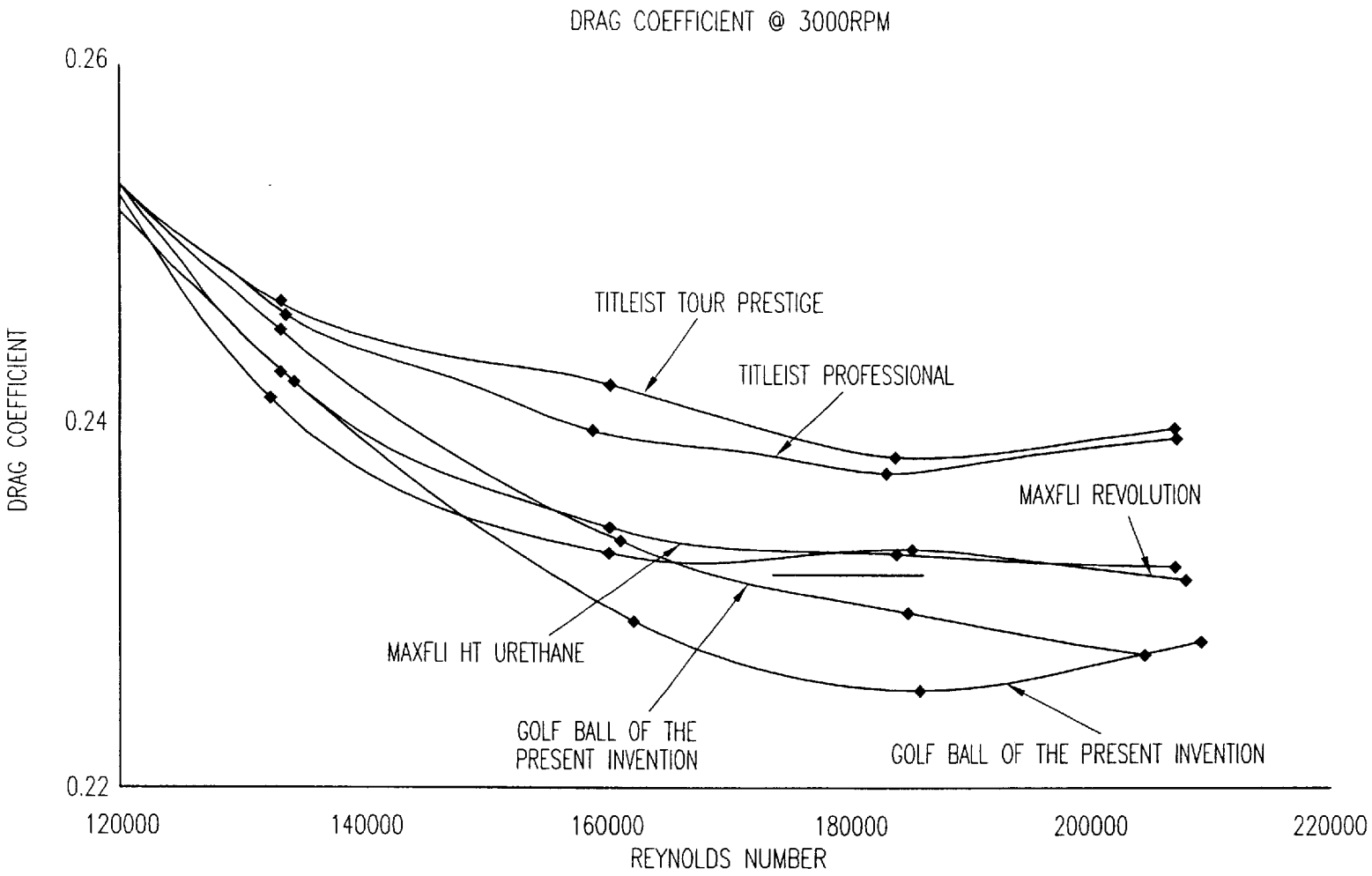
FIG. 18 is graph of the drag coefficient versus Reynolds number.

FIG. 17 illustrates the lift coefficient of a golf ball 20 with the dimple pattern of the present invention thereon as compared to the Titlelist PROFESSIONAL, the Titlelist TOUR PRESTIGE, the Maxfli REVOLUTION and the Maxfli HT URETHANE. FIG. 18 illustrates the drag coefficient of a golf ball 20 with the dimple pattern of the present invention thereon as compared to the Titlelist PROFESSIONAL, the Titlelist TOUR PRESTIGE, the Maxfli REVOLUTION and the Maxfli HT URETHANE. All of the golf balls for the comparison test, including the golf ball 20 with the dimple pattern of the present invention, have a thermoset polyurethane cover. The golf ball 20 with the dimple pattern of the present invention was constructed as set forth in co-pending U.S. patent application Ser. No. 09/361,912 filed on Jul. 27, 1999, for a Golf Ball With A Polyurethane Cover which pertinent parts are hereby incorporated by reference. The aerodynamics of the dimple pattern of the present invention provides a greater lift with a reduced drag thereby translating into a golf ball 20 that travels a greater distance than golf balls of similar constructions.

In this regard, the Rules of Golf, approved by the United States Golf Association ("CUSGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the golf ball 20 should have a dimple pattern that enables the golf ball 20 to meet, yet not exceed, these limits.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball having a surface thereon, the golf ball comprising:

a plurality of dimples disposed on the surface, wherein each of the plurality of dimples has a first edge and a second edge diametrically opposing the first edge, and the radius of curvature of a contour of each of the plurality of dimples is continuous along the entire contour from the first edge to the second edge, wherein a chord depth of a bottom center of each dimple of the plurality of dimples is between 0.0049 inch and 0.0054 inch.

2. The golf ball according to claim 1 wherein the radius of curvature of the contour at the first edge is equal to the curvature of a sphere of the golf ball.

3. The golf ball according to claim 1 wherein the contour of each of the dimples is convex from the first edge to a first inflection point and from the second edge to a second inflection point, and the contour is concave between the first inflection point and the second inflection point.

4. The golf ball according to claim 3 wherein the convex and concave sections of the dimple are each defined by the following equation:

$$P(t)=\Sigma B_t J_{n,i}(t) 0 \leqq t \leqq 1,$$

wherein $$J_{n,i}(t)=\binom{n}{i} t^i (1-t)^{n-i},$$

n is equal to at least five, and i=n+1.

5. The golf ball according to claim 1 wherein the radius of curvature of each point of the contour from a bottom center to the first edge is different from any other point from the bottom center to the first edge.

6. The golf ball according to claim 5 wherein the radius of curvature of each dimple of the plurality of dimples is greatest at the bottom center.

7. The golf ball according to claim 1 wherein each of the plurality of dimples has an entry angle, and the entry angle of each dimple is between 13 and 16 degrees.

8. The golf ball according to claim 1 wherein each of the plurality of dimples has an entry radius, and the entry radius of each dimple is between 0.020 and 0.050 inches.

9. The golf ball according to claim 1 wherein the plurality of dimples comprises:

a first plurality of dimples disposed on the surface, each of the first plurality of dimples having a first diameter;

a second plurality of dimples disposed on the surface, each of the second plurality of dimples having a second diameter, the second diameter greater than the first diameter;

a third plurality of dimples disposed on the surface, each of the third plurality of dimples having a third diameter, the third diameter greater than the second diameter;

a fourth plurality of dimples disposed on the surface, each of the fourth plurality of dimples having a fourth diameter, the fourth diameter greater than the third diameter; and a fifth plurality of dimples disposed on the surface, each of the fifth plurality of dimples having a fifth diameter, the fifth diameter greater than the fourth diameter;

wherein the first, second, third, fourth and fifth pluralities of dimples cover at least eighty percent of the surface of the golf ball.

10. The golf ball according to claim 9 wherein the plurality of dimples further comprises a sixth plurality of dimples disposed on the surface, each of the sixth plurality of dimples having a sixth diameter, the sixth diameter greater than the fifth diameter, wherein the first, second, third, fourth, fifth and sixth pluralities of dimples cover at least eighty-three percent of the surface of the golf ball.

11. The golf ball according to claim 10 wherein the plurality of dimples further comprises at least one seventh dimple disposed on the surface, the at least one seventh dimple having a seventh diameter, the seventh diameter less than the first diameter, wherein the first, second, third, fourth, fifth and sixth pluralities of dimples and the at least one seventh dimple cover at least eighty-six percent of the surface of the golf ball.

12. A golf ball having a thermoset polyurethane cover with a surface thereon, the surface of the thermoset polyurethane cover coated with at least a base coat, the golf ball comprising:

a plurality of dimples disposed on the surface, wherein each of the plurality of dimples has a first edge and a second edge diametrically opposing the first edge, and the radius of curvature of a contour of each of the plurality of dimples is continuous along the entire contour from the first edge to the second edge, wherein a chord depth of a bottom center of each dimple of the plurality of dimples is between 0.0049 inch and 0.0054 inch.

13. The golf ball according to claim 12 wherein the radius of curvature of the contour at the first edge is equal to the curvature of a sphere of the golf ball.

14. The golf ball according to claim 12 wherein the contour of each of the dimples is convex from the first edge to a first inflection point and from the second edge to a second inflection point, and the contour is concave between the first inflection point and the second inflection point.

15. The golf ball according to claim 14 wherein the convex and concave sections of the dimple are each defined by the following equation:

$$P(t)=\Sigma B_i J_{n,i}(t) 0 \leqq t \leqq 1,$$

wherein $$J_{n,i}(t)=\binom{n}{i} t^i (1-t)^{n-i},$$

n is equal to at least five, and i=n+1.

16. The golf ball according to claim 12 wherein the radius of curvature of each point of the contour from a bottom center to the first edge is different from any other point from the bottom center to the first edge.

17. The golf ball according to claim 16 wherein the radius of curvature is greatest at the bottom center.

* * * * *